United States Patent [19]

Evangelow

[11] 4,276,926

[45] Jul. 7, 1981

[54] STOVE PIPE HEATER

[76] Inventor: James Evangelow, R.D. #1, Burlington Flats, N.Y. 13315

[21] Appl. No.: 65,358

[22] Filed: Aug. 9, 1979

[51] Int. Cl.[3] ..... F24B 7/00; F28D 7/00

[52] U.S. Cl. ..... 165/39; 165/47; 165/155; 165/DIG. 2; 237/55; 126/110 R; 126/307 R

[58] Field of Search ..... 165/DIG. 2, DIG. 12, 165/39, 47, 155; 237/55; 126/307 R, 110 R

[56] References Cited

U.S. PATENT DOCUMENTS

| | | | |
|---|---|---|---|
| 17,750 | 7/1857 | Sawyer | 237/55 |
| 289,634 | 12/1883 | Ernst | 237/55 |
| 1,184,677 | 5/1916 | Gilbert | 237/55 |
| 1,529,190 | 3/1925 | Kettering | 165/155 |
| 1,966,360 | 7/1934 | Shaffer | 237/55 |
| 2,311,226 | 2/1943 | Grotenhouse | 165/DIG. 2 |
| 2,479,413 | 8/1949 | Ryan | 165/DIG. 2 |
| 2,634,720 | 4/1953 | Thulman | 237/55 |
| 2,890,866 | 6/1959 | Hansen | 165/DIG. 2 |
| 3,124,197 | 3/1964 | Funk | 165/DIG. 2 |
| 3,475,922 | 11/1969 | Scott et al. | 165/155 |
| 4,050,627 | 9/1977 | Mayer | 237/55 |
| 4,138,062 | 2/1979 | Graden | 237/55 |
| 4,147,303 | 4/1979 | Talucci | 237/55 |

FOREIGN PATENT DOCUMENTS

| | | | |
|---|---|---|---|
| 2304038 | 10/1976 | France | 165/DIG. 2 |

*Primary Examiner*—Albert W. Davis
*Assistant Examiner*—Margaret A. Focarino
*Attorney, Agent, or Firm*—Robert S. Smith

[57] ABSTRACT

Apparatus for saving heat which is otherwise wasted particularly in multi-story buildings. The apparatus in one form includes first, second, and third elongated hollow members which are disposed for at least an axial section in coaxial relationship. The first or central elongated member carries smoke and waste heat away from a heating apparatus such as a furnace. The second and third elongated members are in fluid communication with each other. The second elongated member in one form of the invention is also in fluid communication with an air inlet disposed on one floor of the associated house. The third elongated member is also in fluid communication with another floor of the associated house.

6 Claims, 4 Drawing Figures

STOVE PIPE HEATER

FIELD OF THE INVENTION

The apparatus in accordance with the invention relates to heating apparatus and particularly to heat transfer apparatus for extracting heat that would otherwise be wasted and would pass into the chimney flue. It will be understood that although the apparatus in accordance with the invention has particular application to wood burning stoves, furnaces and the like that it can also be used for other heating apparatus that burns other fuels.

A disadvantage of structures which have been used typically to reclaim heat which is ordinarily wasted when smoke is allowed to escape from a burning fire is that they fail to extract a large portion of the heat which is passed along with the smoke and other combustion products. Another problem with such apparatus is that the heat which may be extracted is made available at some point within a house where it may not be readily used. For example, heat exchangers which may be positioned on a metallic duct connecting a furnace and a chimney typically only provide additional heat in the basement of a multi-story house. Very often there is no real need for additional heat in the basement particularly in those houses which are heated by hot air furnaces having many ducts which extend throughout the basement area.

It is an object of the invention to provide apparatus which will extract a maximum amount of heat from the flue gases.

It is another object of the invention to provide apparatus which will allow substantial control over where the heat extracted from the flue gases is distributed within a multi-story house.

It is another object of the invention to provide apparatus which is inexpensive to manufacture and easy to install within a house or other building.

It is yet another object of the invention to provide apparatus which is shaped to fit within an existing building in a manner that will be space efficient.

SUMMARY OF THE INVENTION

It has now been found that these and other objects of the invention may be attained by heat transfer apparatus for cooperation with an associated multi-story building which includes first and second elongated hollow members. The first member has a circumference which is smaller than the second elongated member. The first member has at least an axial portion which is disposed within the second elongated member. The first elongated member is in fluid communication with an associated combustion chamber on one story of the associated building and the ambient above the building. The second elongated member is disposed in fluid communication with a story of the associated building higher than the story on which the associated combustion chamber is located. In one form the apparatus may include a third elongated member having a circumference greater than the second elongated member and having at least an axial portion disposed around a second elongated member. In this form of the invention the second and third elongated members are disposed in fluid communication at one axial location of both the second and third elongated members. In some embodiments the axial location will be at the upper axial extremity of both the second and third elongated members. The first and second elongated members may be coaxial and similarly the second and third elongated members may also be coaxial.

In some forms each of the elongated members may have a circular cross section. The apparatus may include a blower disposed in fluid communication with the second and third elongated members. The blower may be thermostatically controlled.

BRIEF DESCRIPTION OF THE DRAWING

The invention will be better understood by reference to the accompanying drawing in which.

DESCRIPTION OF THE PREFERRED EMBODIMENTS

Figure 1:
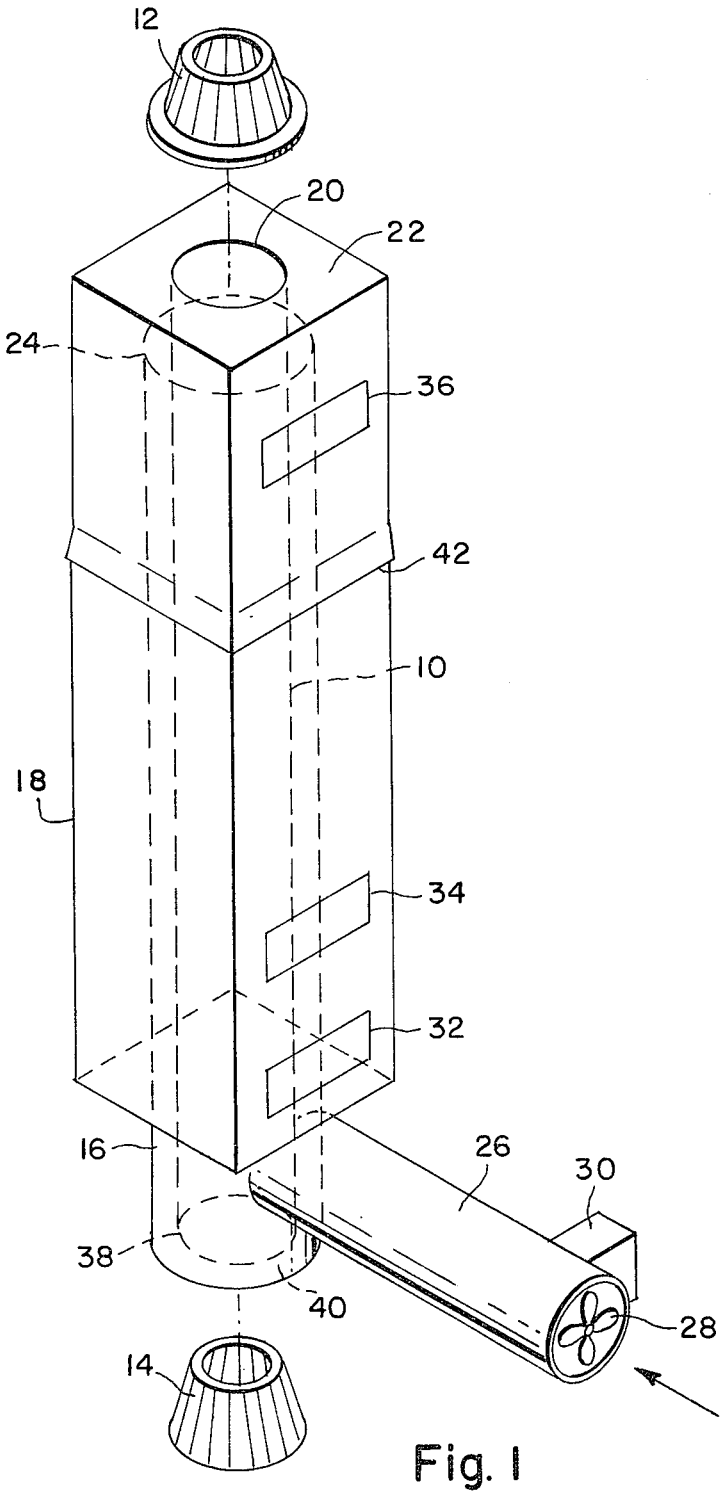
FIG. 1 is perspective view of the apparatus in accordance with one form of the invention.

Referring now to FIG. 1 there is shown a first embodiment of the heat transfer apparatus in accordance with the invention which includes a flue pipe or first elongated member 10. It will be understood that as used herein the term flue pipe and flue each referred to a channel or passage for conveying combustion products from a furnace, boiler, fireplace, or other combustion chamber to or through a chimney. Similarly it will be understood that the flue conveys the flue gas or gaseous combustion products from a combustion source. In some forms of the invention an adapter 12 will connect the upper axial extremity of the first elongated member 10 to a chimney which will extend upwards. In other forms of the invention the first elongated member 10 will communicate directly with a piece of sheet metal duct which will extend directly through the roof of the building in which the apparatus is disposed. A second adapter 14 may be provided at the lower axial extremity of the first elongated member 10 to facilitate interconnection with duct work extending to an associated combustion chamber.

A second elongated member 16 is also circular as is first elongated member 10 and is disposed in coaxial relationship surrounding the first elongated member 10. It will be understood that the first and second elongated members are not in fluid communication with each other. Surrounding the second elongated member 16 is a third elongated member 18 which in this embodiment of the invention has a square cross section. The third elongated member 18 and the first elongated member 10 are not in fluid communication. However, the second and third elongated members respectively 16, 18 are in fluid communication. The upper axial extremity 20 of first elongated member 10 is sealed to the rectangular top 22 of the third elongated member 18 by means of welding or some other very positive metal joining technique which will not be sensitive to the temperatures which will normally be encountered in operation of the invention. It will be seen that the upper axial extremity 24 of the second elongated member 16 is lower than the axial extremity 22 of the third elongated member 18. A horizontal pipe or duct 26 communicates with the lower extremity of the second elongated member 16. Disposed within the duct 26 is a fan 28 which is controlled by electrical apparatus in control box 30 which may include thermostatic controls. It will be understood that the thermostatic controls may include a sensor which is located near a location where heat may be discharged by the apparatus in accordance with the invention. It will be understood that the elongated members 10, 16, and 18 each extend normally a vertical distance which is greater than the distance between the floor and ceiling of the building in which it is used. The third elongated member 18 is normally provided with knockouts or regions which have been stamped about their periphery so that they can be readily removed. In a typical apparatus in accordance with the invention knockout 32 will be positioned at a higher elevation than the horizontal duct 26. Accordingly in a form of the invention in which the knockout 32 is opened and perhaps connected to an extender duct, which will distribute the heated air in a manner which may be particularly suitable, relatively cool air will be drawn in by blower 28, forced down duct 26 into the second elongated member 16 up to the top 24 and into the third elongated member 18 where it will proceed downward to the outlet 32. The outlet 32 may be, for example, positioned below the ceiling of the floor in which the duct 26 is disposed. Similarly in a typical installation the knockouts 34 and 36 will be disposed at a higher story than the story in which the duct 26 is disposed and will be disposed respectively near the floor of that story and near the ceiling of that story.

In operation the flue gases from an associated combustion chamber will pass into the lower extremity 38 of the first elongated member 10 (which is isolated from the second elongated member 16 by means of annular member 40) and continue up the length of the first elongated member 10 to the outlet or upper axial extremity 20 of that member. Simultaneously air will be drawn in through blower 28 into duct 26 and be forced up second elongated member 16 and into third elongated member 18 and then out one of the knockouts 32, 34, 36. In one form of the invention the thermostatic controls in the control box 30 will control the blower so that it will operate only when heating is desired at the location where heat is ejected by the third elongated member 18. Various forms of the apparatus in accordance with the invention in which individual elongated members may be modular may have axial sections which have axial extremities which will slide together. An example of this is shown at the mating surface 42 in the third elongated member 18. It will be further understood that the apparatus in accordance with the invention may include modular axial sections which may be rotated 90, 180 or 270 degrees from the position which is shown in FIG. 1. This feature will permit much greater flexibility in determining the location of the air inlet for air to be heated and the air outlet for directing air which has already been heated. It will be understood that in embodiments of the invention utilizing circular cross section duct work that axial modular segments will permit still greater flexibility in the angular orientation of the inlets and outlets.

Figure 2:
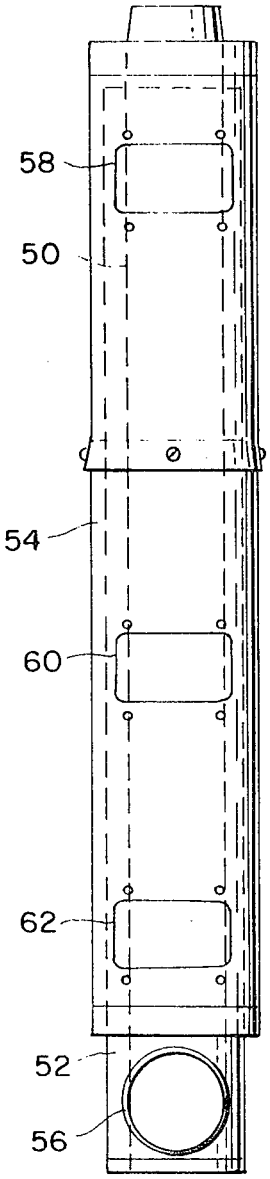
FIG. 2 is a front elevational view of a second embodiment of the invention.
Figure 3:
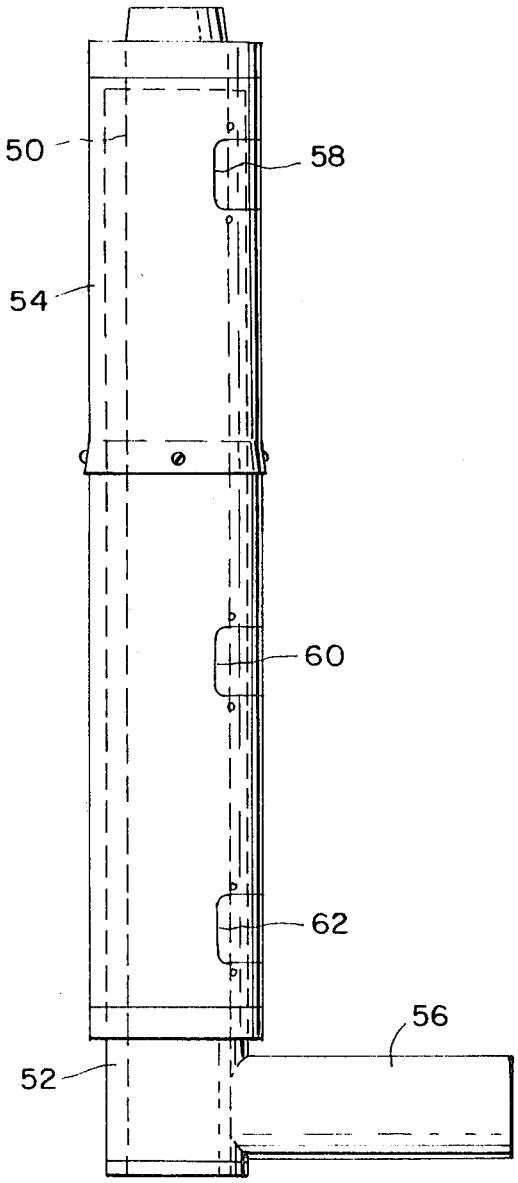
FIG. 3 is a side elevational view of the apparatus shown in FIG. 2.
Figure 4:
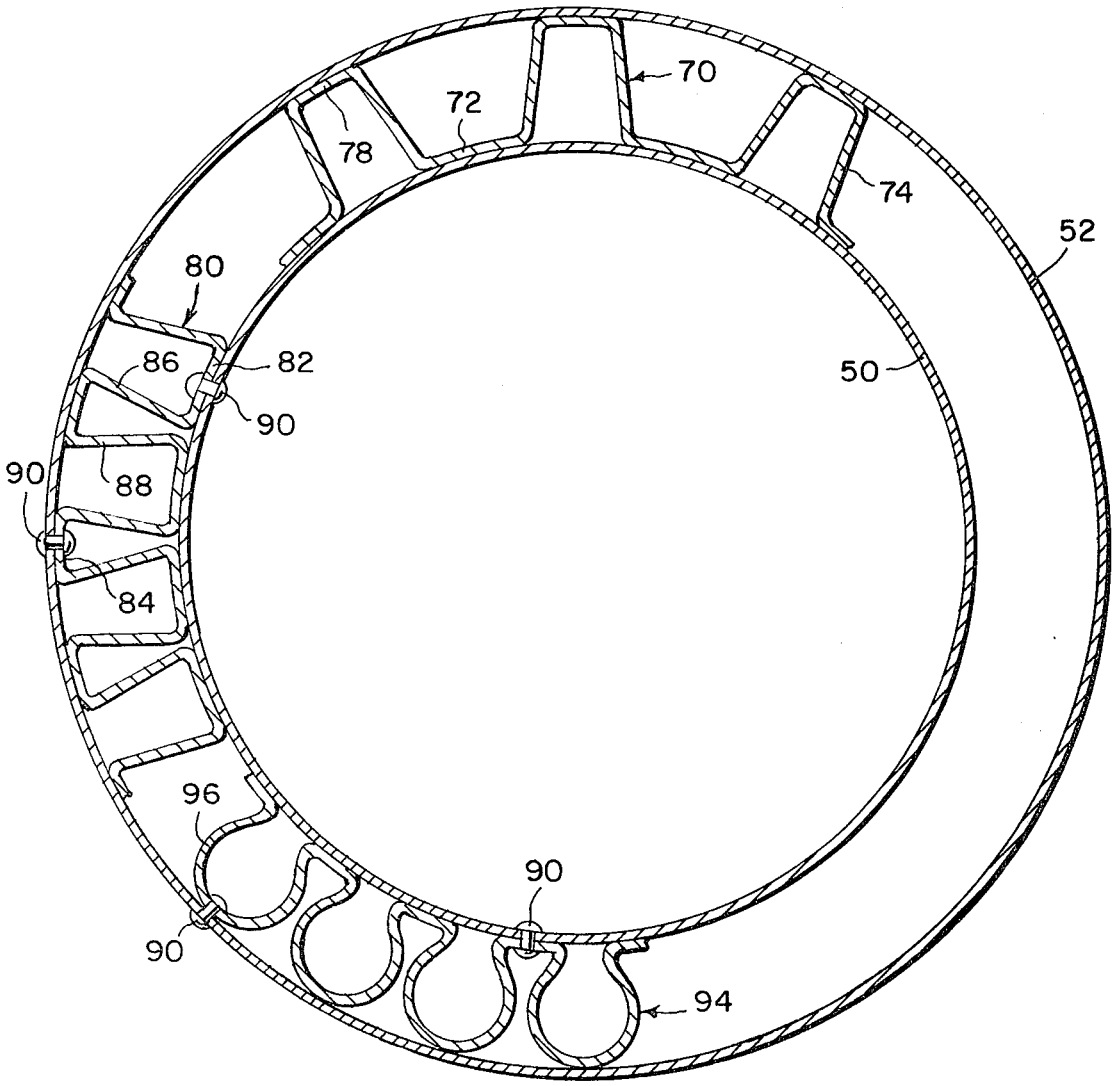
FIG. 4 is a partial cross-sectional view illustrating various ways in which concentric elongated members in accordance with the invention may be secured relative to each other in a manner which will provide a rigid structure and which will also optimize heat transfer between the coaxial members.

Referring now to FIGS. 2, 3, and 4 there is shown another embodiment of the invention in which first, second and third elongated member identified respecively by the numerals 50, 52, and 54 are disposed in concentric relationship. A horizontal duct 56 communicates with the second elongated member 52 as in the embodiment of FIG. 1. The second elongated member 52 is in fluid communication at the top axial extremity thereof with the top axial extremity of the third elongated member 54. The third elongated member 54 is sealed to the first elongated member 50 at the top axial extremity thereof. Knockouts 58, 60 and 62 are provided in a manner similar to that shown in FIG. 1.

FIG. 4 illustrates various alternate structures which will provide the desired positional relationship between, for example, first and second elongated members 50, 52 and in addition provides desirable heat transfer therebetween. Cleats 70 are provided with an arcuate section 72 which is in close thermal contact with the wall of first elongated member 50 to maximize thermal conduction and a very generally radially disposed wall 74 which is in turn fixed to an outer wall 78. In another variation of the cleat identified by the numeral 80 the wall sections 82 and 84 have a relatively long circumferential dimension because of the highly desirable slope of the intervening webs 86, 88. The wall sections 82, 84 may be secured to the first and second elongated members by rivets 90.

In another embodiment a cleat is identified by the numeral 94. The dimension of the portion of the cleat 94 which bears on the first elongated member 50 is relatively large to maximize the heat transfer between the first and second elongated members which have, of course, the highest thermal gradient therebetween. The arcuate web 96 connects the cleat to the second elongated member 52. Rivets 90 may again be used.

It will be understood that the embodiments which use a thermostatic control for the blower will function most readily where a fire is maintained in a substantially constant manner. Such fires typically will be wood or hard coal fires which are ordinarily not turned on and off as readily as oil fired and gas fired apparatus. In those embodiments of the invention where the apparatus cooperates with an oil or gas fired combustion apparatus it will be understood that the electrical controls for the blower 28 may be interconnected so that the blower operates only when the combustion apparatus is functioning or in some cases for the same period as the fan would operate on a hot air gas or oil fired furnace. Those skilled in the art will understand that the fan will typically come on after the combustion apparatus has started for some finite predetermined time and will continue in operation often for some finite predetermined time after combustion has ceased. Although the apparatus has been shown in terms of an inlet for air to be heated which goes into the second elongated members and then flows into the third elongated member before flowing out to heat part of a building, it will be understood that the flow could be easily reversed and that the flow could go into the third elongated member and then into the second elongated member before flowing to some area which is to be heated. In some forms of the invention only two concentric elongated members may be necessary and air will be forced into an outer concentric member and then discharged out of that elongated member into a room on another floor of the builing which is being heated. It will be understood that the cleats which have been described herein optimize the conduction of heat from the first elongated member. In accordance with one form of the invention shown in FIG. 1 the first elongated member may have a seven inch diameter, the second elongated member may have a nine inch diameter and the third elongated member may be a square which is eleven inches on each side. The knockouts in that form of the invention may measure three inches by eight inches so that they will cooperate with conventional air vent registers. In the embodiment shown in FIGS. 2, 3, and 4 the first elongated member may have a diameter of six inches, the second elongated member may have a diameter of eight inches, and the third elongated member may have a diameter of ten inches.

Having thus described my invention I claim:

1. A heat transfer apparatus, for cooperation with an associated multistory building, which comprises first and second elongated hollow members, said first elongated hollow member having a circumference which is smaller than the circumference of said second elongated hollow member, said first elongated hollow member having at least an axial portion disposed within said second elongated hollow member, said first elongated hollow member being in fluid communication with an associated combustion chamber on one story of the associated building, and also in fluid communication with the ambient above the associated building, said second elongated hollow member being disposed in fluid communication with an outlet register which is in fluid communication with a story of the associated building higher than the story on which the associated combustion chamber is located, said apparatus further including a third elongated hollow member having a circumference greater than said second elongated hollow member and said third elongated hollow member having at least an axial portion disposed around said second elongated hollow member, said second and third elongated hollow members being in fluid communication at one axial location of each, and said one axial location is at the upper axial extremity of both said second and third elongated hollow members.

2. The apparatus as described in claim 1, wherein said first and second elongated hollow members are coaxial.

3. The apparatus as described in claim 2, wherein said second and third elongated hollow members are coaxial.

4. The apparatus as described in claim 3, wherein each of said elongated hollow members has a substantially round cross section.

5. The apparatus as described in claim 4, further including a blower disposed in fluid communication with an inlet in fluid communication with said second and third elongated hollow members, said blower urges air through said second and third elongated members to increase a transfer of heat from said first elongated hollow member.

6. The apparatus as described in claim 5, wherein said blower is themostatically controlled.

* * * * *